US006260280B1

(12) United States Patent
Rapisardi

(10) Patent No.: US 6,260,280 B1
(45) Date of Patent: Jul. 17, 2001

(54) KNIFE WITH CERAMIC BLADE

(76) Inventor: Keith Rapisardi, R.R. 1 Box 145A, Uniondale, PA (US) 18470

( * ) Notice: Subject to any disclaimer, the term of this patent is extended or adjusted under 35 U.S.C. 154(b) by 0 days.

(21) Appl. No.: 09/503,239

(22) Filed: Feb. 11, 2000

(51) Int. Cl.[7] ..... B26B 9/02

(52) U.S. Cl. ..... 30/357; 30/346.53; 30/349; 30/351

(58) Field of Search ..... 30/350, 351, 357, 30/348, 349, 346.53; 451/557, 552; 125/12, 22

(56) References Cited

U.S. PATENT DOCUMENTS

| | | | | |
|---|---|---|---|---|
| 2,688,439 | | 8/1954 | Tobert | 76/112 |
| 3,543,402 | * | 12/1970 | Seager | 30/346.53 |
| 3,834,265 | * | 9/1974 | Tafapolsky et al. | 83/651 |
| 4,211,006 | | 7/1980 | Halaby et al. | 30/346.55 |
| 4,532,708 | * | 8/1985 | Mensing | 30/350 |
| 4,534,827 | * | 8/1985 | Henderson | 30/346 |
| 4,689,242 | | 8/1987 | Pike | 427/34 |
| 4,862,890 | | 9/1989 | Stasz et al. | 128/303.14 |
| 4,963,061 | | 10/1990 | Katbi et al. | 407/114 |
| 5,048,191 | * | 9/1991 | Hahn | 30/346.54 |
| 5,077,901 | * | 1/1992 | Warner et al. | 30/357 |
| 5,621,974 | * | 4/1997 | Rose et al. | 30/349 |
| 5,863,329 | * | 1/1999 | Yamanouchi | 118/100 |
| 5,873,168 | * | 2/1999 | Johnson et al. | 30/134 |

* cited by examiner

*Primary Examiner*—M. Rachuba
*Assistant Examiner*—Sean Pryor
(74) *Attorney, Agent, or Firm*—Goldstein Law Offices P.C

(57) ABSTRACT

A knife with ceramic blade including a body portion having a lower end. The lower end has a generally triangular lower portion extending downwardly therefrom. The lower portion has a lower end forming an apex. The apex has a channel formed therein extending a length of the body portion. A plurality of ceramic blades are provided that each have an elongated vertical upper segment and a lower cutting edge. The elongated vertical upper segment of each ceramic blade is received within the channel formed in the apex of the lower portion of the elongated body portion.

3 Claims, 2 Drawing Sheets

KNIFE WITH CERAMIC BLADE

BACKGROUND OF THE INVENTION

The present invention relates to a knife with ceramic blade and more particularly pertains to providing a superior cutting instrument with a surrounding support structure.

Recent attempts at knife design have made use of ceramic blades which are sharper and more abrasive and wear-resistant than any other material used to make cutlery. Ceramic is totally corrosion-resistant, non-conducting, and does not have a magnetic signature. Unfortunately, ceramic is extremely brittle due to its hardness and crystalline structure. Ceramic blades will break or chip when flexed or dropped on a hard surface. Unless the cutting with a ceramic blade is taking place in a controlled environment, a broken blade is the likely result. Because field use of a knife can be very unpredictable and is usually very stressful on a knife blade, a ceramic blade for field use has been unachievable.

What is needed is a ceramic blade that can be utilized for all purposes, including field use. The present invention attempts to provide a solution to the abovementioned problems by providing a ceramic blade with a support structure that will prevent the blade from breaking while under stress.

The use of cutting tools is known in the prior art. More specifically, cutting tools heretofore devised and utilized for the purpose of cutting objects are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,689,242 to Pike discloses a method for adhesion of grit to blade tips. U.S. Pat. No. 4,963,061 to Katbi et al. discloses a ceramic cutting insert. U.S. Pat. No. 4,862,890 to Stasz et al. discloses an electro surgical spatula blade with ceramic substrate. U.S. Pat. No. 5,863,329 to Yamanouchi discloses a ceramic composite doctor blade. U.S. Pat. No. 4,211,006 to Halaby et al. discloses a guarded razor blade. U.S. Pat. No. 2,686,439 to Tobert discloses a method of making cutting tools. U.S. Pat. No. 5,048,191 to Hahn discloses razor blade technology.

While these devices fulfill their respective, particular objective and requirements, the aforementioned patents do not describe a knife with ceramic blade for providing a superior cutting instrument with a surrounding support structure.

In this respect, the knife with ceramic blade according to the present invention substantially departs from the conventional concepts and designs of the prior art, and in doing so provides an apparatus primarily developed for the purpose of providing a superior cutting instrument with a surrounding support structure.

Therefore, it can be appreciated that there exists a continuing need for a new and improved knife with ceramic blade which can be used for providing a superior cutting instrument with a surrounding support structure. In this regard, the present invention substantially fulfills this need.

SUMMARY OF THE INVENTION

In the view of the foregoing disadvantages inherent in the known types of cutting tools now present in the prior art, the present invention provides an improved knife with ceramic blade. As such, the general purpose of the present invention, which will be described subsequently in greater detail, is to provide a new and improved knife with ceramic blade which has all the advantages of the prior art and none of the disadvantages.

To attain this, the present invention essentially comprises an elongated body portion having a generally rectangular upper portion. The upper portion has a lower end. The lower end has a generally triangular lower portion extending downwardly therefrom. The lower portion has a lower end forming an apex. The apex has a channel formed therein extending a length of the body portion. A plurality of ceramic blades are provided that each have an elongated vertical upper segment and a lower cutting edge. The elongated vertical upper segment of each ceramic blade is received within the channel formed in the apex of the lower portion of the elongated body portion. The ceramic blades each have a slight space disposed between one another. Each vertical upper segment has a pair of apertures therethrough.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved knife with ceramic blade which has all the advantages of the prior art cutting tools and none of the disadvantages.

It is another object of the present invention to provide a new and improved knife with ceramic blade which may be easily and efficiently manufactured and marketed.

It is a further object of the present invention to provide a new and improved knife with ceramic blade which is of durable and reliable construction.

An even further object of the present invention is to provide a new and improved knife with ceramic blade which is susceptible of a low cost of manufacture with regard to both materials and labor, and which accordingly is then susceptible of low prices of sale to the consuming public, thereby making such a knife with ceramic blade economically available to the buying public.

Even still another object of the present invention is to provide a new and improved knife with ceramic blade for providing a superior cutting instrument with a surrounding support structure.

Lastly, it is an object of the present invention to provide a new and improved knife with ceramic blade including a body portion having a lower end. The lower end has a generally triangular lower portion extending downwardly therefrom. The lower portion has a lower end forming an apex. The apex has a channel formed therein extending a length of the body portion. A plurality of ceramic blades are provided that each have an elongated vertical upper segment and a lower cutting edge. The elongated vertical upper segment of each ceramic blade is received within the channel formed in the apex of the lower portion of the elongated body portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
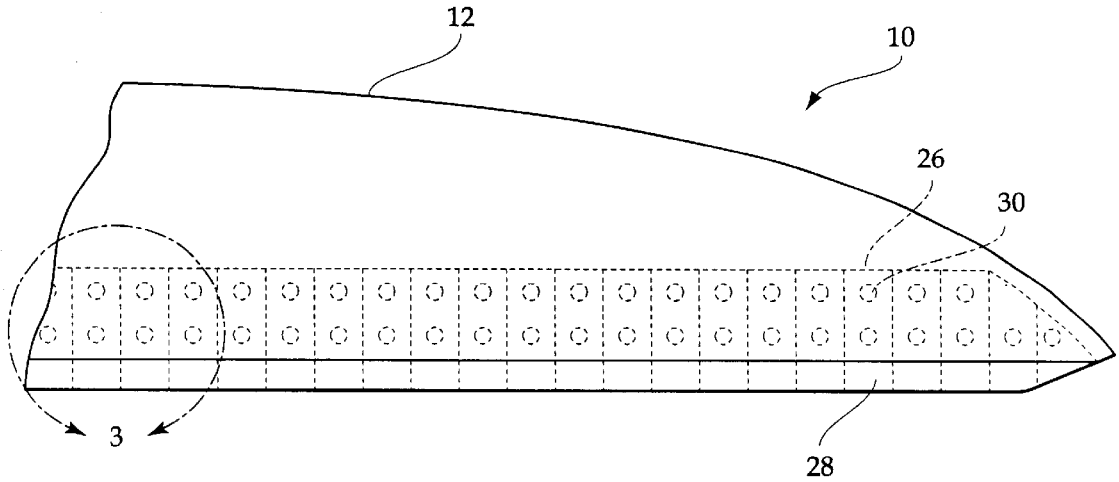
FIG. 1 is a side view of the preferred embodiment of the knife with ceramic blade constructed in accordance with the principles of the present invention.
Figure 2:
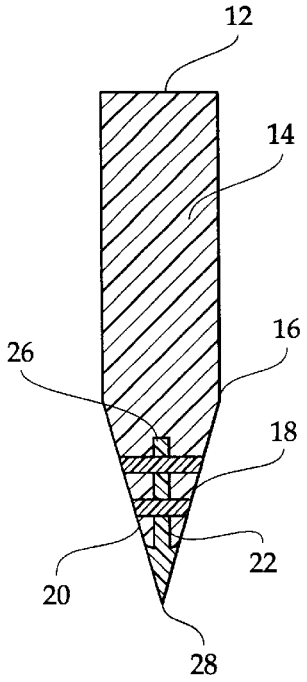
FIG. 2 is a cross-sectional front view of the present invention illustrating the securement of the ceramic blades to the body portion.
Figure 3:
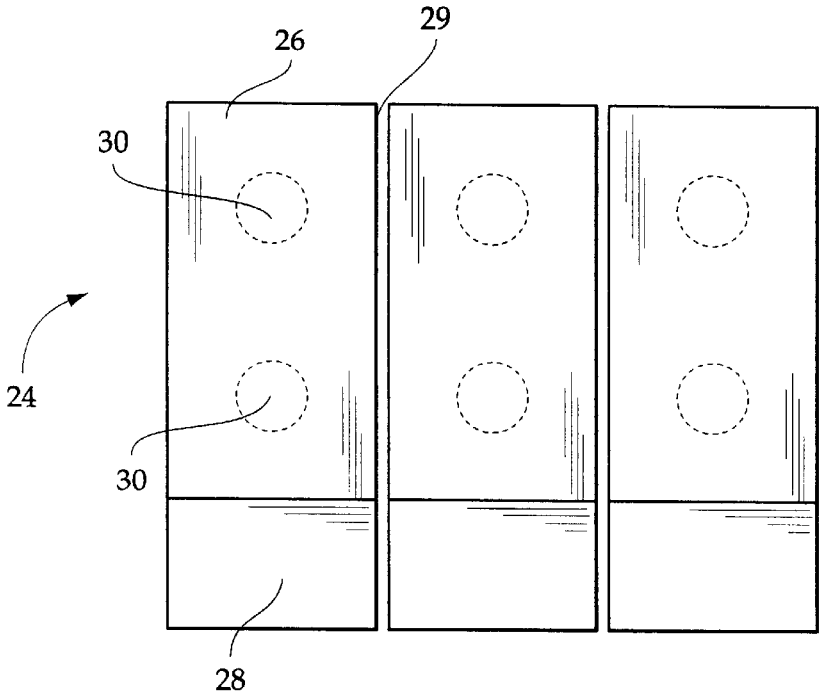
FIG. 3 is a sectional view of the present invention as taken from circle 3 of FIG. 1.

With reference now to the drawings, and in particular, to FIGS. 1 through 4 thereof, the preferred embodiment of the new and improved knife with ceramic blade embodying the principles and concepts of the present invention and generally designated by the reference number 10 will be described.

Specifically, it will be noted in the various Figures that the device relates to a knife with ceramic blade for providing a superior cutting instrument with a surrounding support structure. In its broadest context, the device consists of an elongated body portion and a plurality of ceramic blades. Such components are individually configured and correlated with respect to each other so as to attain the desired objective.

The elongated body portion 12 has a generally rectangular upper portion 14. The upper portion 14 has a lower end 16. The lower end 16 has a generally triangular lower portion 18 extending downwardly therefrom. The lower portion 18 has a lower end forming an apex 20. The apex 20 has a longitudinal channel 22 formed therein extending a length of the body portion 12. The body portion 12 can be fabricated in a variety of shapes and sizes. The preferable construction of the body portion 12 is of a synthetic material that is strong, light, impervious to the elements and very easy to work with.

Figure 4:
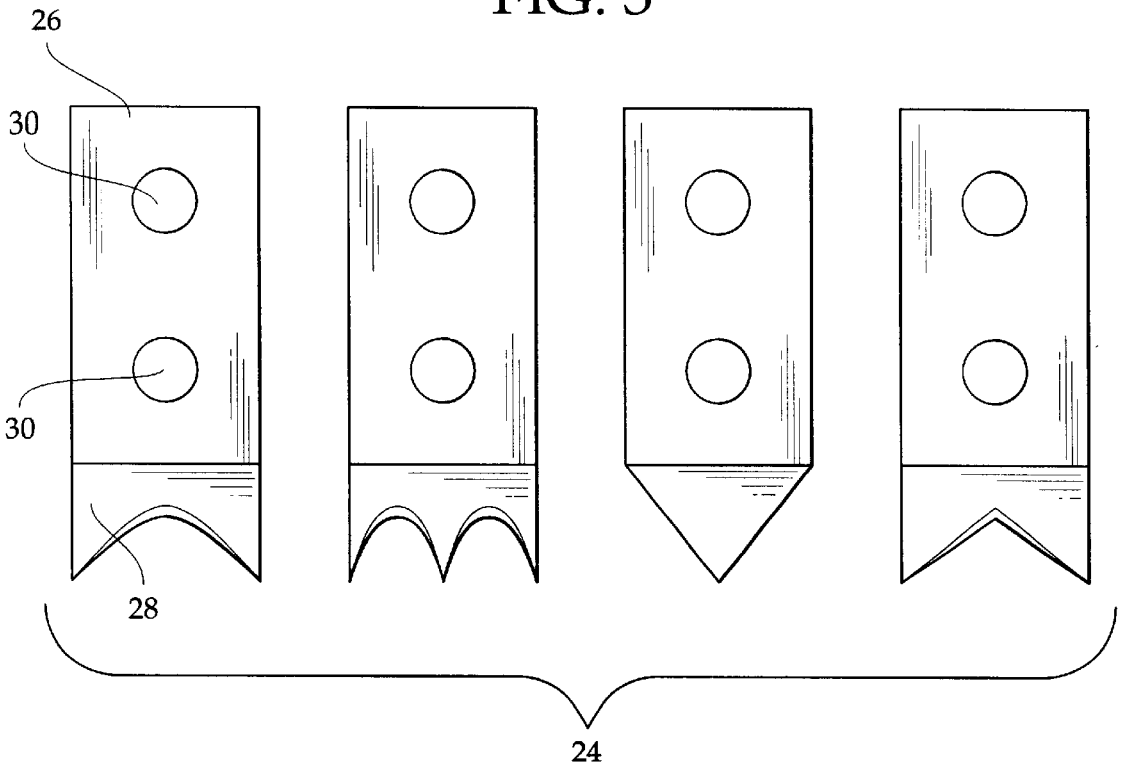
FIG. 4 is a side view of an example of the different types of ceramic blades available within the present invention.

The plurality of ceramic blades 24 each have an elongated vertical upper segment 26 and a lower cutting edge 28. The elongated vertical upper segment 26 of each ceramic blade 24 is received within the channel 22 formed in the apex 20 of the lower portion 18 of the elongated body portion 12. The ceramic blades 24 each have a slight space 29 disposed between adjacent ceramic blades 24 The spaces allow for the material of the body portion 12 to flow therein during manufacture. Each vertical upper segment 26 has a pair of apertures 30 extending therethrough from front to back. The different types of blades 24 that can be used in association with the present invention are illustrated in FIG. 4. It should be noted that these blades 24 are merely illustrative of the vast number of different blade designs that could be utilized.

The vertical upper segments 26 will be imbedded into the channel 22 of the body portion 12 at the time of manufacture. The lower cutting edge 28 of the ceramic blades 24 are the only exposed portion of the ceramic blades 24. The apertures 30 are designed as flow-through ports, allowing the body portion 12 material to stabilize the ceramic blades 24 in their position. Note FIG. 2.

The present invention combines the strengths of the ceramic blades 24 with the synthetic structure of the body portion 12. The ceramic blades 24are simply placed side by side within the channel 22 of the body portion 12. The vertical upper segments 26 of the ceramic blades 24 are actually molded into the body portion 12 as it is being formed. Whether the body portion 12 is cast as a liquid or as a composite, the ceramic blades 24 become an integral part of the body portion 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A knife, comprising:

a plurality of ceramic blades, each having a lower cutting edge and vertical upper segment, each ceramic blade having a front and a back, each ceramic blade having at least one aperture in the vertical upper segment extending fully between the front and back;

a body portion having an upper portion and a lower end, the lower end having a longitudinal channel, wherein the vertical upper segments of all of the ceramic blades extend within the longitudinal channel, and wherein the body portion is made of a body portion material such that the body portion material encases the vertical upper portion with the body portion material flowing through the at least one aperture in each ceramic blade, such that the lower cutting edge of each ceramic blade is the only exposed portion of said ceramic blade.

2. The knife as recited in claim 1, wherein each ceramic blade has at least two vertically aligned apertures, which each extend fully between the front and back, so that the body portion material can flow therethrough to fully encase the vertical upper segment of that ceramic blade to create a strong bond between the ceramic blade and the body portion.

3. The knife as recited in claim 2, wherein the ceramic blades are separated from adjacent ceramic blades by a slight space, such that the body portion material flows between the adjacent ceramic blades to more fully bond with and encase said ceramic blades.

* * * * *